US007810433B2

(12) United States Patent
Kumpfmüller et al.

(10) Patent No.: US 7,810,433 B2
(45) Date of Patent: Oct. 12, 2010

(54) DEVICE FOR THE ASSEMBLY AND DISASSEMBLY OF A FASTENING DEVICE, MORE PREFERABLY A RAIL FASTENING DEVICE ON A SUPPORT BODY

(75) Inventors: Nicole Kumpfmüller, München (DE); Harald Mauer, Germering (DE); Dieter Mrosowski, Stein-Wingert (DE); Karsten Westerhoff, Witten (DE); Andreas Rinsdorf, Freudenberg (DE)

(73) Assignee: DB Netz AG, Frankfurt am Main (DE)

( * ) Notice: Subject to any disclaimer, the term of this patent is extended or adjusted under 35 U.S.C. 154(b) by 252 days.

(21) Appl. No.: 12/220,059

(22) Filed: Jul. 21, 2008

(65) Prior Publication Data

US 2009/0120318 A1 May 14, 2009

(51) Int. Cl.
*E01B 29/26* (2006.01)

(52) U.S. Cl. ..... 104/17.1; 104/17.2; 104/2

(58) Field of Classification Search ..... 104/17.1, 104/17.2, 2; 29/16; 173/213
See application file for complete search history.

(56) References Cited

U.S. PATENT DOCUMENTS

| | | | | |
|---|---|---|---|---|
| 3,120,193 | A * | 2/1964 | Pettigrew et al. | 104/17.2 |
| 3,257,962 | A * | 6/1966 | Doorley et al. | 104/17.1 |
| 4,131,067 | A * | 12/1978 | Newman et al. | 104/17.1 |
| 4,273,052 | A * | 6/1981 | Woolner et al. | 104/17.1 |
| 4,907,740 | A * | 3/1990 | Oberweiler et al. | 238/283 |
| 5,096,119 | A * | 3/1992 | Schultheiss et al. | 238/349 |
| 5,191,840 | A * | 3/1993 | Cotic et al. | 104/17.1 |
| 5,577,447 | A * | 11/1996 | Weber et al. | 104/2 |
| 6,257,495 | B1 * | 7/2001 | Eisenberg | 238/349 |
| 6,832,558 | B2 * | 12/2004 | Weber et al. | 104/2 |
| 7,156,319 | B2 * | 1/2007 | Kowalski | 238/265 |
| 2007/0017474 | A1 * | 1/2007 | Muhr et al. | 123/188.3 |
| 2009/0120318 | A1 * | 5/2009 | Kumpfmuller et al. | 104/2 |

FOREIGN PATENT DOCUMENTS

| | | |
|---|---|---|
| DE | 25 50 819 | 6/1976 |
| DE | 37 20 381 | 1/1989 |
| DE | 601 03 475 | 9/2004 |

* cited by examiner

*Primary Examiner*—S. Joseph Morano
*Assistant Examiner*—Jason C Smith
(74) *Attorney, Agent, or Firm*—Collard & Roe, P.C.

(57) ABSTRACT

The invention describes a device for the assembly and disassembly of a fastening device, more preferably of a rail fastening device on a support body, wherein the device is designed as screw adapter and the screw adapter is to be placed on the rail fastening device.

Figure 1:
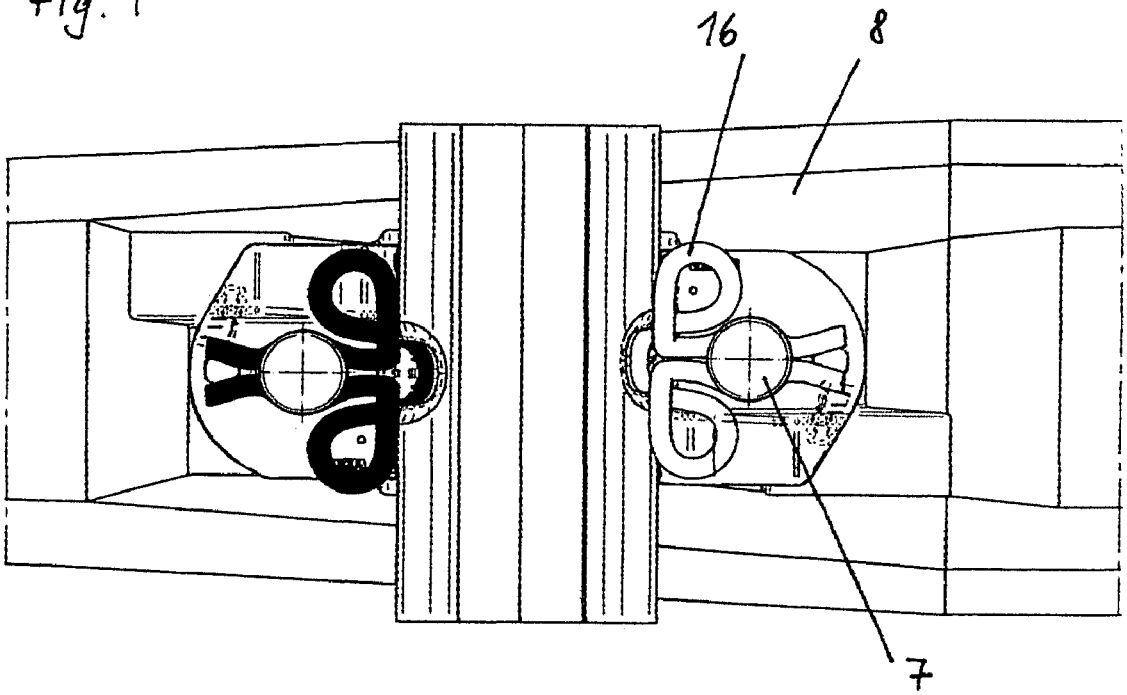

The invention is based on developing a device for the assembly and disassembly of a rail fastening device which sits on the fastening device with an accurate fit and largely guarantees automated screwing in and screwing out of the fastening device in existing engagement stages.

According to the invention this is achieved in that the screw adapter comprising an engagement pin at its stem, in the contact surface of its main body possesses a centrally arranged recess to accommodate the head of a fastening element, wherein the main body on both sides next to this recess comprises two mounting pockets designed trough-shaped as well as a stop.

3 Claims, 3 Drawing Sheets

DEVICE FOR THE ASSEMBLY AND DISASSEMBLY OF A FASTENING DEVICE, MORE PREFERABLY A RAIL FASTENING DEVICE ON A SUPPORT BODY

CROSS REFERENCE TO RELATED APPLICATIONS

Applicants claim priority under 35 U.S.C. §119 of German Application No. 10 2007 053 901.2 filed on Nov. 9, 2007.

The invention describes a device for the assembly and disassembly of a fastening device, more preferably a rail fastening device on a support body, wherein the device is embodied as screw adapter and the screw adapter is to be placed on the rail fastening device.

Various machines for rail fastening are known wherein the primary concern is the screwing in or out of the bolts or the rail screws or the clamping devices for railway tracks (DE 25 50 819 A1, DE 601 03 475 T2, DE 37 20 381 A1). Here, the screws used can be turned by means of simple hand-guided rotary tools. No additional tool is generally required since the spring/clamp can be manually moved once the screw has been loosened.

The disadvantage of all screwing devices known to date is that these can no longer be used for new types of springs/clamps with a clip function for establishing turning-in from the preassembly into the operating position.

The invention is therefore based on developing a device for the assembly and disassembly of a rail fastening device which sits on the fastening device with an accurate fit and substantially guarantees automated turning in and out of the fastening device in existing engagement stages.

According to the invention this is achieved in that the screw adapter comprising an engagement pin at its stem possesses a centrally arranged recess to accommodate the head of a fastening device in the contact surface of its main body, wherein the main body on both sides next to this recess comprises two mounting pockets embodied trough-shaped as well as a stop!

The mounting pockets on the main body embodied trough-shaped each comprise a lateral guide.

The mounting pockets in the main body embodied trough-shaped each comprise a flattened under-grip.

The device for the assembly and disassembly of rail fastening devices can be employed with track constructions whose support bodies are embodied as both known track sleepers irrespective of type as well as a concrete structure of the fixed road or as another structure.

ADVANTAGES OF THE INVENTION

- The fastening device can be automatically turned from the preassembly position in the operating or final assembly position and vice versa
- The exact starting of the screw adapter on the fastening device in the preassembly position is made possible via positions which are defined in the tool by means of engagement stages and which can be automatically approached
- It is safeguarded that the final assembly position is achieved without twisting/distortion of the fastening device
- The angular offset between the fastening device located on the inside of the track and the fastening system located on the outside of the track relative to the longitudinal axis of the device is automatically offset through the appropriate engagement stages when approaching the next engagement position in alternation track inside/track outside so that no overloads can occur
- During disassembly of a fastening device the screw adapter can be relocated from the final assembly position to the preassembly position by simply changing the direction of rotation
- By forming an engagement pin at the stem of the screw adapter that can be used for nearly all existing screwing devices it can be connected to all hydraulic screwing devices
- The screw adapter can be operated by one person without problems The invention is explained in more detail in the following by means of an exemplary embodiment.

Here it shows:

FIG. 1—the rail fastening system in top view

Figure 2:
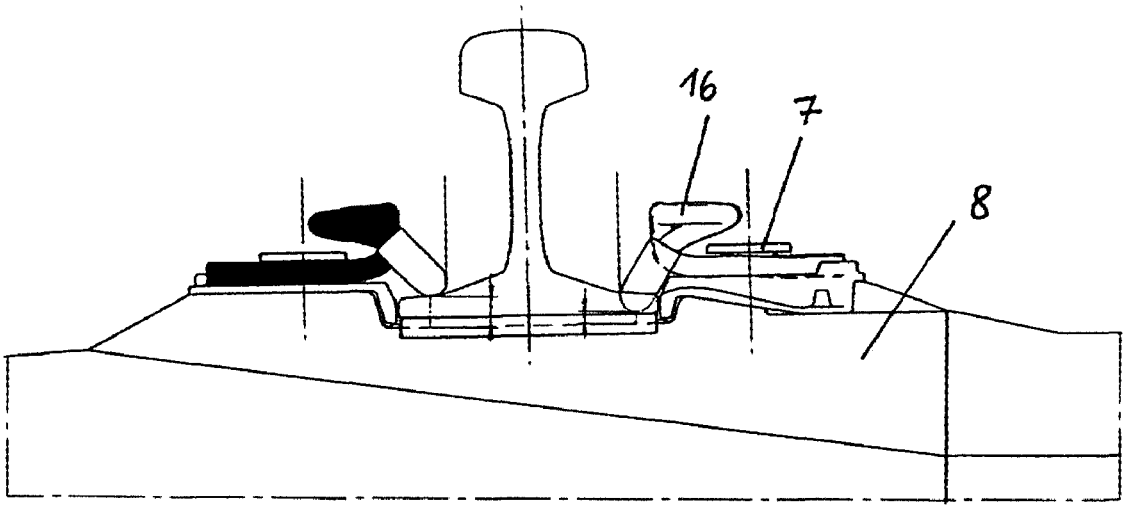

FIG. 2—the rail fastening system in cross section

Figure 3:
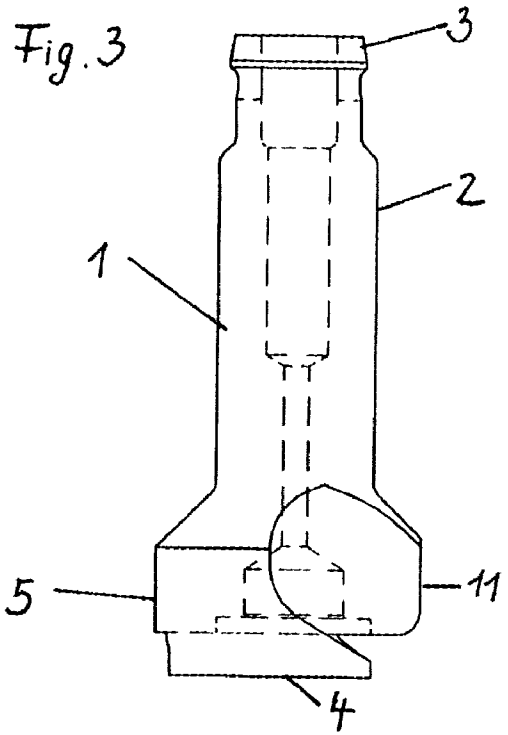

FIG. 3—the corresponding screw adapter in lateral view

Figure 4:
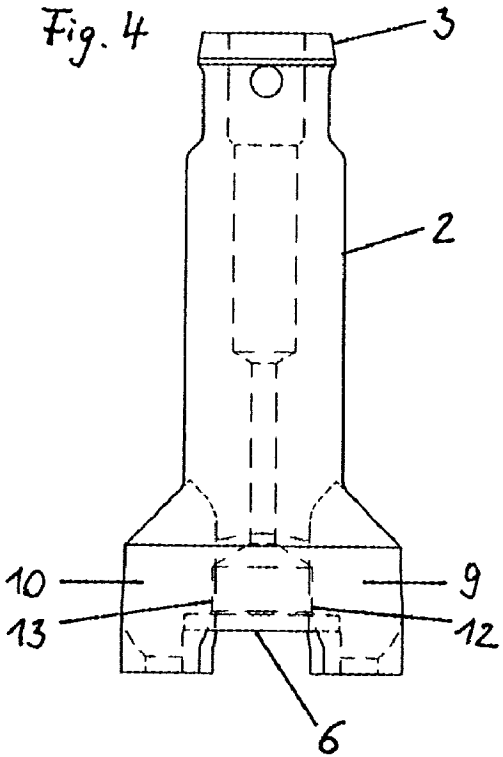

FIG. 4—the screw adapter in the rearward view

Figure 5:
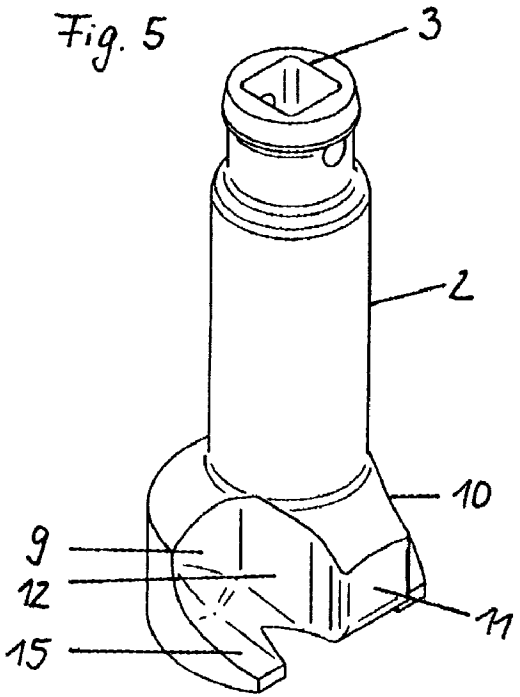

FIG. 5—the screw adapter in a three dimensional lateral view

Figure 6:
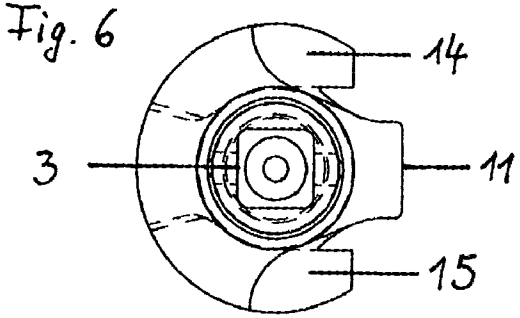

FIG. 6—the screw adapter in top view

Figure 7:
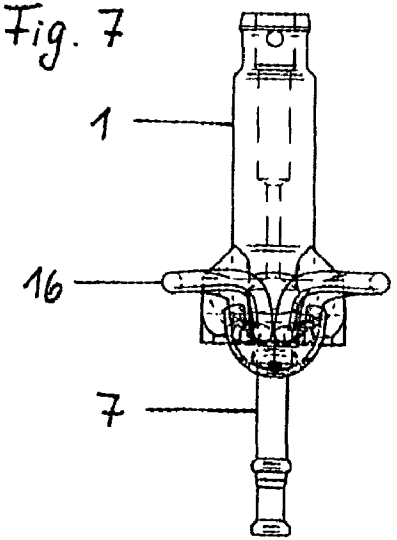

FIG. 7—the screw adapter with fastening system and element in front view

Figure 8:
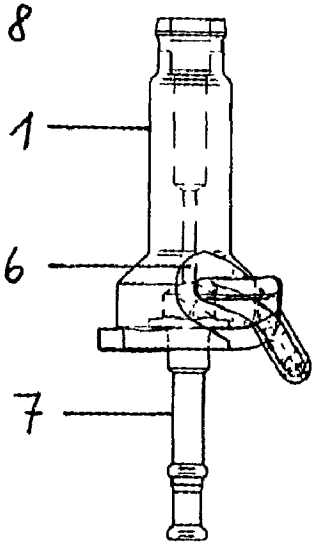

FIG. 8—the screw adapter with fastening system and element in lateral view

Figure 9:
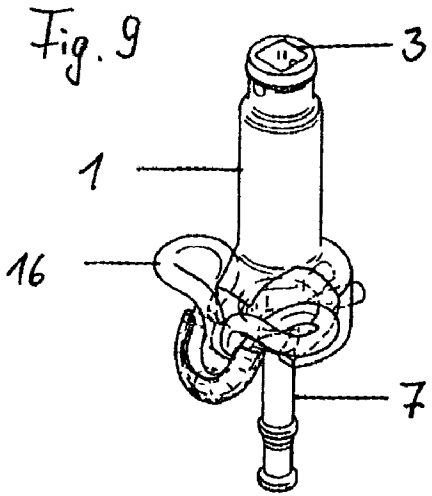
Figure 10:
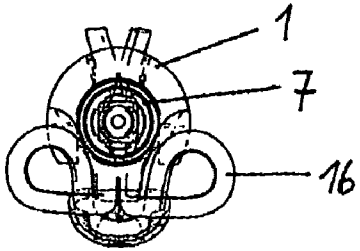

FIG. 9—the screw adapter with fastening system and element in a three dimensional lateral view FIG. 10—the screw adapter with fastening system and element in top view The screw adapter 1 on its stem 2 comprises the engagement pin 3 of square design to accommodate the screwing machine which is not shown (FIG. 5). The contact surface 4 of the main body 5 comprises a centrally arranged recess 6 for accommodating the head of the fastening element 7, which is sunk in the support body embodied as sleeper 8 (FIGS. 1, 2).

Furthermore, the main body 5 on both sides comprises two mounting pockets 9; 10 embodied trough-shaped next to the recess 6 as well as centrally a stop 11 (FIGS. 3, 4, 6). The trough-shaped mounting pockets 9; 10 each additionally comprise on the main body 5 the lateral guides 12; 13 and an under-grip 14; 15 of flattened design each for accommodating and fixing the spring loops 14 of the fastening device 16.

FIGS. 7 to 10 show the interaction of the screw adapter 1 with the fastening device 16 and the fastening device 7.

Here, the screw adapter 1 as tool braces itself on the fastening device 7 centrally in such a manner that the force (torque) introduced into the tool during the assembly or disassembly of the fastening device 15 leads to the turning-in of the fastening device 15 onto the head of the fastening element 7 without the possibility of deformation of said fastening element occurring.

The screw adapter 1 via the special shape of the trough-shaped mounting pockets 9; 10 in conjunction with the two lateral guides 12, 13 and the under-grips 14; 15 designed flattened achieves a fixing on the fastening device 16 by means of geometrical positive connection. Slipping-off of the screw adapter 1 cannot occur because of this special positive connection. The squarely designed engagement pin 3 additionally grants a non-positive connection with the screwing machine used in each case, which is exchangeable.

The screw adapter 1 automatically approaches the respective angles of rotation (starting, turning in final assembly position, starting with rotational offset on the opposite side of the track) required and stops without overloading the fastening device 16 or the fastening element 7.

LIST OF REFERENCE NUMBERS USED

1—Screw adapter
2—Stem
3—Engagement pin
4—Contact surface
5—Main body
6—Recess
7—Fastening element
8—Sleeper (support body)
9—Trough-shaped mounting pocket
10—Trough-shaped mounting pocket
11—Stop
12—Lateral guide
13—Lateral guide
14—Flattened under-grip
15—Flattened under-grip
16—Fastening device

The invention claimed is:

1. A device for the assembly and disassembly of a fastening device, wherein the device is embodied as screw adapter and the screw adapter is to be placed on the rail fastening device, wherein the screw adapter (1) which, on its stem (2) comprises an engagement pin (3), and in a contact surface (4) of its main body (5) possesses a centrally arranged recess (6) to accommodate a head of a fastening element (7), wherein the main body (5) on both sides next to this recess (6) comprises two trough-shaped mounting pockets (9; 10) and a stop (11).

2. The device according to claim 1, wherein the trough-shaped mounting pockets (9; 10) on the main body (5) each comprise a lateral guide (12; 13).

3. The device according to claim 1, wherein the trough-shaped mounting pockets (9; 10) on the main body (5) each comprise a flattened under-grip (14; 15).

* * * * *

UNITED STATES PATENT AND TRADEMARK OFFICE

CERTIFICATE OF CORRECTION

PATENT NO. : 7,810,433 B2
APPLICATION NO. : 12/220059
DATED : October 12, 2010
INVENTOR(S) : Kumpfmüller et al.

It is certified that error appears in the above-identified patent and that said Letters Patent is hereby corrected as shown below:

On the title page: item [30], please add the Claim of Priority of the Foreign Application Priority data as follows:

-- Nov. 9, 2007 (DE)..... 10 2007 053 901.2 --.

Signed and Sealed this

Seventh Day of December, 2010

David J. Kappos

David J. Kappos
*Director of the United States Patent and Trademark Office*